US011060687B2

(12) United States Patent
Kizaki

(10) Patent No.: US 11,060,687 B2
(45) Date of Patent: Jul. 13, 2021

(54) HEADLIGHT DEVICE INCLUDING A MAIN LIGHT SOURCE AND AN AUXILIARY LIGHT SOURCE

(71) Applicant: HONDA MOTOR CO., LTD., Tokyo (JP)

(72) Inventor: Tokujiro Kizaki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/323,997

(22) PCT Filed: Aug. 30, 2017

(86) PCT No.: PCT/JP2017/031176

§ 371 (c)(1),
(2) Date: Feb. 7, 2019

(87) PCT Pub. No.: WO2018/051791

PCT Pub. Date: Mar. 22, 2018

(65) Prior Publication Data

US 2019/0178462 A1 Jun. 13, 2019

(30) Foreign Application Priority Data

Sep. 13, 2016 (JP) ..... JP2016-178810

(51) Int. Cl.
*F21S 41/40* (2018.01)
*F21S 41/148* (2018.01)
(Continued)

(52) U.S. Cl.
CPC ..... *F21S 41/40* (2018.01); *F21S 41/148* (2018.01); *F21S 41/30* (2018.01); *F21W 2107/17* (2018.01)

(58) Field of Classification Search
CPC ..... F21S 41/148; F21S 41/30; F21S 41/32; F21S 41/321; F21S 41/338; F21S 41/40; F21S 41/435; F21S 41/43; F21W 2107/17
See application file for complete search history.

(56) References Cited

U.S. PATENT DOCUMENTS 1,357,761 A * 11/1920 Brown ..... F21V 7/09 362/247
1,432,395 A * 10/1922 Horton ..... F21V 7/09 362/243
(Continued)

FOREIGN PATENT DOCUMENTS

DE 102014110841 A1 * 2/2016 ..... F21S 41/13
EP 2 998 646 A1 3/2016
(Continued)

OTHER PUBLICATIONS

Sato, "High-Beam Headlamp Unit and Vehicle Headlamp", Feb. 23, 2015, J-PlatPat (machine translation of original JP 2015-037033 A), JP 2015-037033 A, pp. 1-18.*
(Continued)

*Primary Examiner* — Alan B Cariaso
(74) *Attorney, Agent, or Firm* — Birch, Stewart, Kolasch & Birch, LLP

(57) ABSTRACT

A headlight device includes a first light source, a shielding part disposed in front of the first light source, and a frame provided between a housing and a lens, the frame including an illumination opening that defines an illumination range for light from the first light source. Thus, it is possible to provide a headlight device that can alleviate glare even when it includes an auxiliary light source.

4 Claims, 9 Drawing Sheets

(51) Int. Cl.
*F21S 41/30* (2018.01)
*F21W 107/17* (2018.01)

(56) References Cited

U.S. PATENT DOCUMENTS 1,435,014 A * 11/1922 Lewis ..... F21S 41/43 362/243
1,451,893 A * 4/1923 Ryan ..... B60Q 1/14 362/243
1,798,132 A * 3/1931 Bredsvold ..... F21S 41/365 362/236
2,228,476 A * 1/1941 Murray ..... F21S 41/323 362/284
2005/0180158 A1* 8/2005 Komatsu ..... F21V 7/0091 362/545
2007/0183168 A1* 8/2007 Naganawa ..... B60Q 1/085 362/545
2008/0062709 A1* 3/2008 Mochizuki ..... F21V 29/70 362/539
2010/0328963 A1 12/2010 Miyagawa
2014/0133169 A1* 5/2014 Schwaiger ..... F21S 41/13 362/516
2015/0078022 A1* 3/2015 Bauer ..... F21S 41/37 362/510
2017/0227184 A1* 8/2017 Ishida ..... F21S 41/365

FOREIGN PATENT DOCUMENTS

JP 2002-216509 A 8/2002
JP 2011-14300 A 1/2011
JP 2014-93285 A 5/2014
JP 2015-37033 A 2/2015
JP 2015176859 A 10/2015
JP 2016-62828 A 4/2016
JP 5969218 B2 8/2016
WO WO-2016096608 A1 * 6/2016 ..... F21S 41/19

OTHER PUBLICATIONS

Rainer Kauschke, "Lighting Device with a device for defrosting and/or defrosting the cover lens", Feb. 4, 2016, Machine Translation of DE 102014110841 to English, pp. 1-8.*
International Search Report, issued in PCT/JP2017/031176, dated Oct. 24, 2017.

* cited by examiner

HEADLIGHT DEVICE INCLUDING A MAIN LIGHT SOURCE AND AN AUXILIARY LIGHT SOURCE

TECHNICAL FIELD

The present invention relates to a headlight device that includes a main light source and an auxiliary light source.

BACKGROUND ART

Patent Document 1 discloses a headlight device mounted on a two-wheeled motor vehicle. The headlight device includes a main light source and an auxiliary light source.

RELATED ART DOCUMENTS

Patent Documents

Patent Document 1: Japanese Patent No. 5969218

SUMMARY OF THE INVENTION

Problems to be Solved by the Invention

Since the auxiliary light source emits light directly to the outside there is a possibility that a person who views it will feel that it is too bright.

The present invention has been accomplished in light of the above circumstances, and it is an object thereof to provide a headlight device that can alleviate glare even when it includes an auxiliary light source.

Means for Solving the Problems

According to a first aspect of the present invention, there is provided a headlight device comprising a first light source, a shielding part disposed in front of the first light source, and a frame provided between a housing and a lens, the frame comprising an illumination opening that defines an illumination range for light from the first light source.

According to a second aspect of the present invention, in addition to the first aspect, the headlight device comprises a second light source and a reflector that reflects light of the second light source, the shielding part being the reflector.

According to a third aspect of the present invention, in addition to the first aspect, the frame provided between the housing and the lens is the shielding part.

According to a fourth aspect of the present invention, in addition to the second aspect, the shielding part is a frame provided between the housing and the lens, and in a front view of a vehicle body an end part of the shielding part formed from the frame is disposed further outward than an end part of the reflector.

According to a fifth aspect of the present invention, in addition to the second aspect, the headlight device comprises a connecting part connected to a board of the second light source to a rear of the housing, and the first light source is provided at a rear end of the housing.

Effects of the Invention

In accordance with the first aspect, due to the first light source including the shielding part it becomes possible to alleviate glare.

In accordance with the second aspect, the dimensions of the headlight device can be reduced in a front view of the vehicle body. Shielding of the first light source becomes possible with a small number of components.

In accordance with the third aspect, due to the first light source including the shielding part it becomes possible to alleviate glare.

In accordance with the fourth aspect, indirect light due to reflection by the reflector becomes available.

In accordance with the fifth aspect, wiring for the first light source can be shortened.

EXPLANATION OF REFERENCE NUMERALS AND SYMBOLS

25 Headlight device
35 Lens
37 Housing
41 Frame
42 Shielding part (first reflector)
44 Shielding part (second reflector)
52 Illumination opening (first auxiliary illumination opening)
53 Illumination opening (second auxiliary illumination opening)
58 Second light source (first main light source)
59 Second light source (second main light source)
63 First light source (first auxiliary light source)
65 First light source (second auxiliary light source)
68 Connecting part (coupler)

MODES FOR CARRYING OUT THE INVENTION

One embodiment of the present invention is explained below by reference to the attached drawings.

FIRST EMBODIMENT

Figure 1:
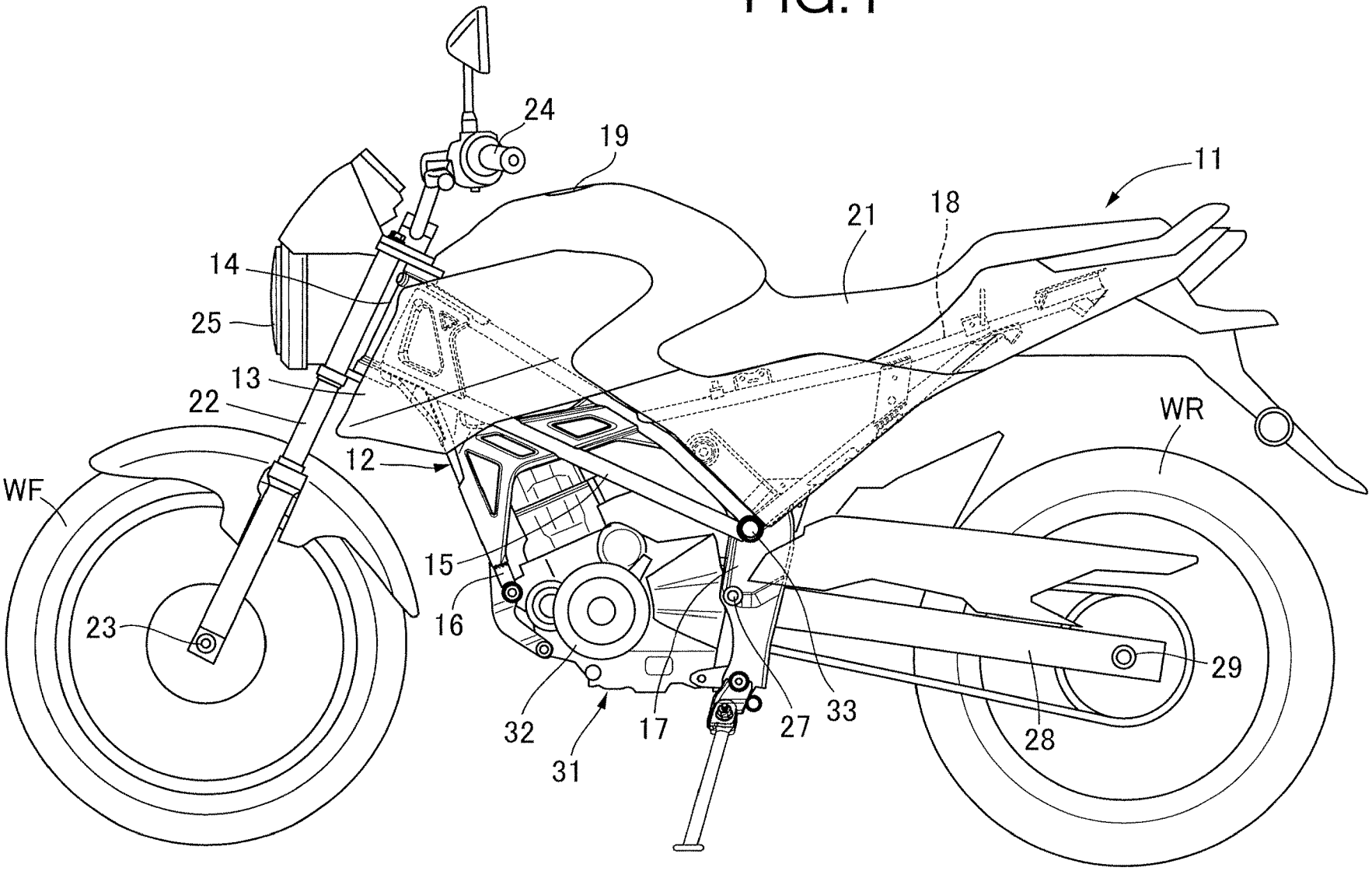
FIG. 1 is a side view schematically showing an overall picture of a saddle-ridden vehicle, that is, a two-wheeled motor vehicle, related to one embodiment. (first embodiment)

FIG. 1 schematically shows an overall picture of a saddle-ridden vehicle, that is, a two-wheeled motor vehicle, related to one embodiment. The two-wheeled motor vehicle 11 includes a vehicle body frame 12 and a vehicle body cover 13 that partially covers the vehicle body frame 12. The vehicle body frame 12 has a head pipe 14, a pair of left and right main frames 15 extending from the head pipe 14 downward to the rear, a pair of left and right down frames 16 extending from the head pipe 14 downward to the rear beneath the main frame 15, a pair of left and right pivot frames 17 joined to the rear end of the respective main frame 15 and extending downward, and a pair of left and right seat frames 18 extending from the respective main frame 15 upward to the rear. An occupant seat 21 is mounted on the seat frame 18 to the rear of a fuel tank 19. The fuel tank 19 is covered by the vehicle body cover 13. The vehicle body cover 13 is molded from for example a resin material.

A front fork 22 is steerably supported on the head pipe 14. A front wheel WF is supported on the front fork 22 so that it can rotate around an axle 23. Handlebars 24 are linked to the upper end of the front fork 22. A headlight device 25 is fixed to the handlebars 24 in front of the head pipe 14.

A swing arm 28 is linked to the vehicle body frame 12 in the rear of the vehicle so that it can swing vertically around a pivot 27. A rear wheel WR is supported at the rear end of the swing arm 28 so that it can rotate around an axle 29. An internal combustion engine unit 31 is mounted on the vehicle body frame 12 between the front wheel WF and the rear wheel WR. The internal combustion engine unit 31 includes an internal combustion engine 32 that generates a driving force transmitted to the rear wheel WR.

The lower end of the main frame 15 is linked to a rear side of the internal combustion engine 32, and the lower end of the down frame 16 is linked to a front side of the internal combustion engine 32. Thus, a rigid structure is established by means of the internal combustion engine 32 in addition to the main frame 15 and the down frame 16. The left and right pivot frames 17 are linked to each other via a cross tube 33 extending in the horizontal direction. The pivot 27 is supported on the pivot frame 17.

Figure 2:
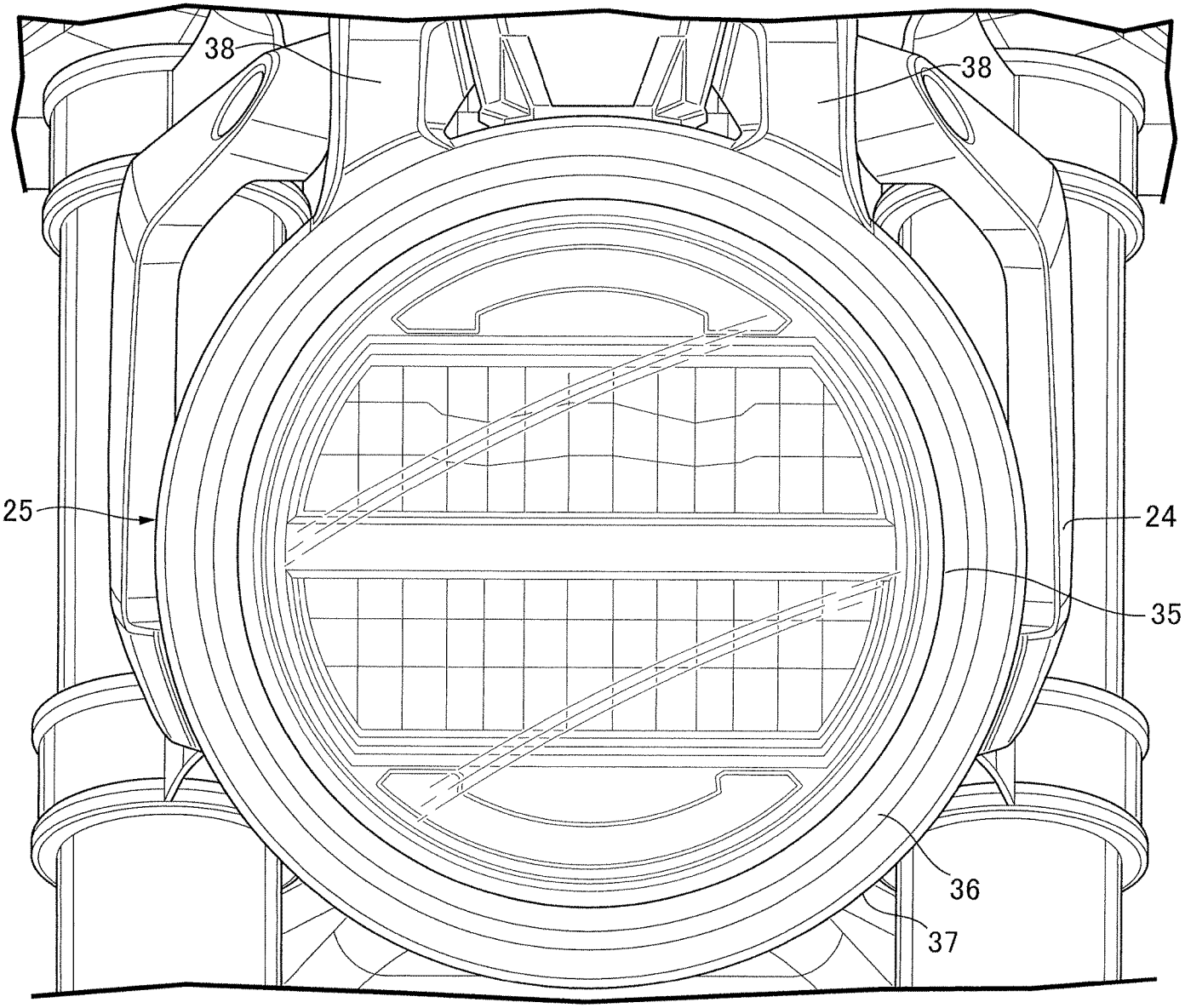
FIG. 2 is an enlarged front view showing the appearance of a headlight device. (first embodiment)

As shown in FIG. 2, the headlight device 25 includes a frame body 36 supporting a transparent lens 35 by surrounding the outer periphery of the lens 35. Here, the outline of the lens 35 is formed as a circular shape. The frame body 36 is formed into a ring shape that receives the outer periphery of the lens 35. The lens 35 and the frame body 36 are coaxially disposed. The frame body 36 fixes the lens 35 to a housing 37. Provided integrally with the housing 37 is a bracket 38 linked to the handlebars 24.

Figure 3:
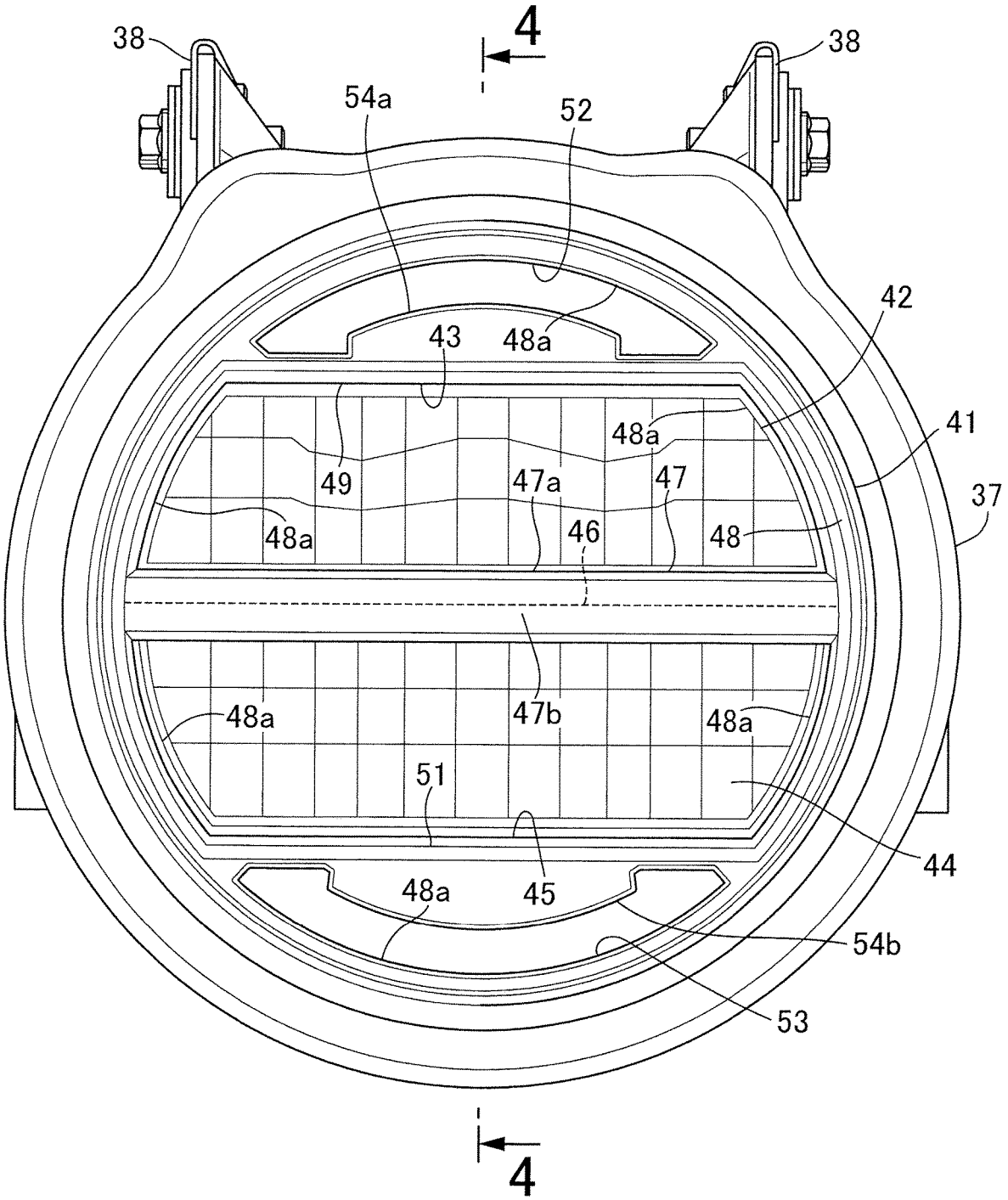
FIG. 3 is an enlarged front view schematically showing the structure of a frame inside a lens. (first embodiment)

As shown in FIG. 3, a light-impermeable frame 41 is housed in a cylindrical body of the housing 37 inside the lens 35. The frame 41 is fitted into an opening of the housing 37. The frame 41 is molded from for example a metal material. The frame 41 defines a first illumination opening 43 that defines an illumination range for light from a first reflector 42 for low beam and a second illumination opening 45 that defines an illumination range for light from a second reflector 44 for high beam. The first illumination opening 43 and the second illumination opening 45 are separated from each other by means of a long center frame 47 extending along one diameter line 46. The center frame 47 is partitioned by means of border lines 47*a* and 47*b* parallel to the one diameter line 46, which is horizontal. Opposite ends of the center frame 47 are linked to an annular body 48 that is continuous along the inner periphery of the cylindrical body.

The lower edge of the first illumination opening 43 is partitioned by means of the border line 47*a* of the center frame 47. The upper edge of the first illumination opening 43 is partitioned by means of a segment 49 that is parallel to the one diameter line 46. Opposite ends of the upper edge and opposite ends of the lower edge are connected to each other via an inner edge 48*a* of the annular body 48. The inner edge 48*a* of the annular body 48 is partitioned by means of a partial circle that is concentric with the outline of the lens 35.

Similarly, the upper edge of the second illumination opening 45 is partitioned by means of the border line 47*b* of the center frame 47. The lower edge of the second illumination opening 45 is partitioned by means of a segment 51 that is parallel to the one diameter line 46. Opposite ends of the lower edge and opposite ends of the upper edge are connected to each other via the inner edge 48*a* of the annular body 48. The inner edge 48*a* of the annular body 48 is partitioned by means of a partial circle that is concentric with the outline of the lens 35.

The frame 41 defines a first auxiliary illumination opening 52 that extends along the inner edge 48*a* of the annular body 48 above the first illumination opening 43 and a second auxiliary illumination opening 53 that extends along the inner edge 48*a* of the annular body 48 beneath the second illumination opening 45. The first auxiliary illumination opening 52 defines an illumination range for light from an auxiliary light source that is hidden behind the first reflector 42. The second auxiliary illumination opening 53 defines an illumination range for light from an auxiliary light source that is hidden behind the second reflector 44. Here, the upper edge of the first auxiliary illumination opening 52 is partitioned by means of the inner edge 48*a* of the annular body 48, and the lower edge of the first auxiliary illumination opening 52 is partitioned by means of an arc 54*a* that is concentric with the annular body 48. Therefore, the first auxiliary illumination opening 52 extends in an arc shape with a uniform width. Similarly, the lower edge of the second auxiliary illumination opening 53 is partitioned by means of the inner edge 48*a* of the annular body 48, and the upper edge of the second auxiliary illumination opening 53 is partitioned by means of an arc 54*b* that is concentric with the annular body 48. Therefore, the second auxiliary illumination opening 53 extends in an arc shape with a uniform width.

Figure 4:
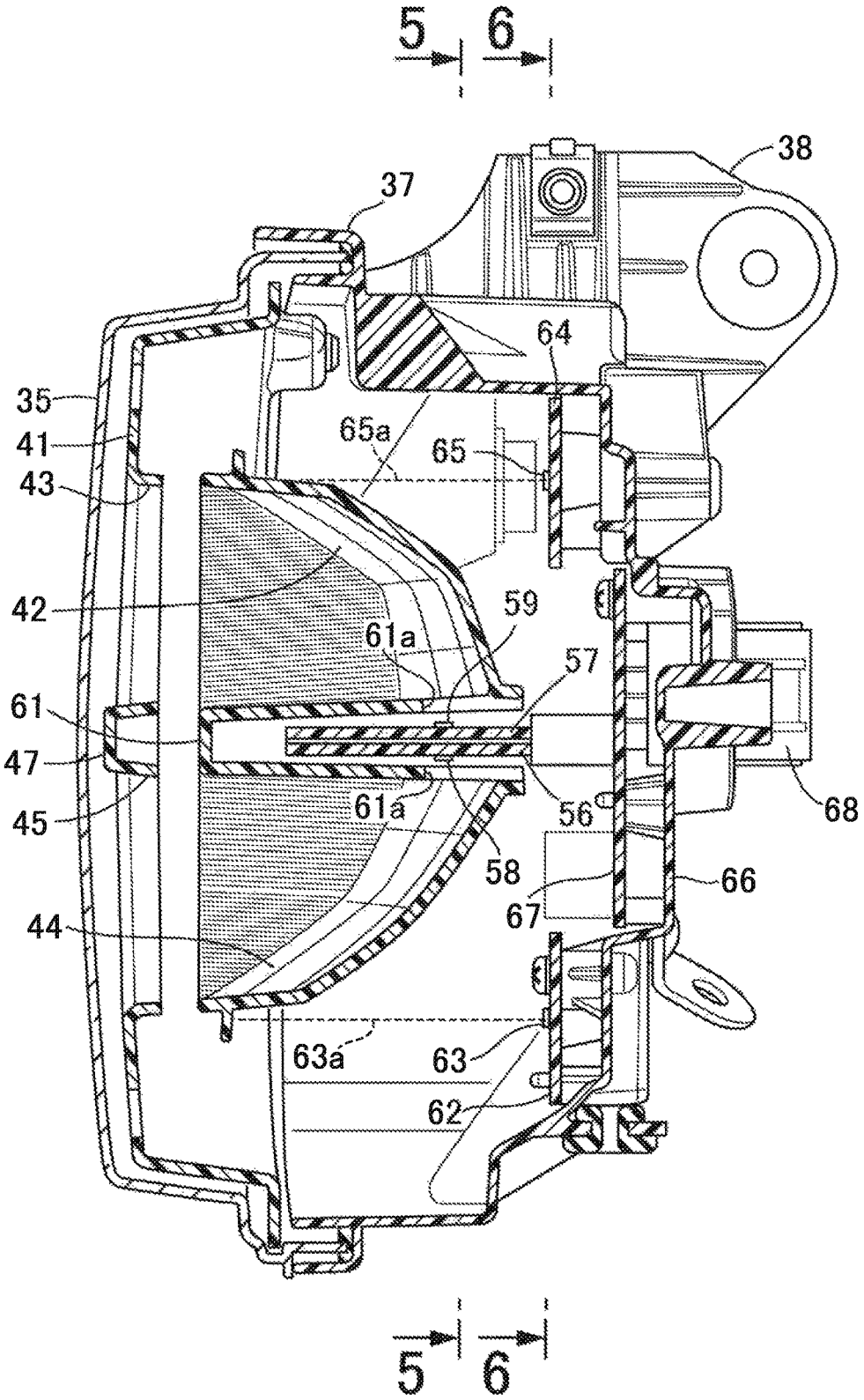
FIG. 4 is a sectional view along line 4-4 in FIG. 3. (first embodiment)

As shown in FIG. 4, a first board 56 and a second board 57, which are in a horizontal attitude, are fixed to the housing 37 on the reverse side of the center frame 47. A lower face of the first board 56 opposes the second reflector 44. A first main light source 58 is mounted on the lower face of the first board 56. The first main light source 58 is formed from for example a surface-emitting LED device having directivity in the vertical direction of the board. The second reflector 44 reflects light from the first main light source 58 toward the second illumination opening 45. Light is emitted forward from the second illumination opening 45. Similarly, an upper face of the second board 57 opposes the first reflector 42. A second main light source 59 is mounted on the upper face of the second board 57. The second main light source 59 is formed from for example a surface-emitting LED device having directivity in the vertical direction of the board. The first reflector 42 reflects light from the second main light source 59 toward the first illumination opening 43. Light is emitted forward from the first illumination opening 43.

The first board 56 and the second board 57 are partially housed in an enclosure 61. The enclosure 61 is molded from a light-impermeable material. A rear edge 61*a* of the enclosure 61 is partitioned by a light path defined from the first main light source 58 and the second main light source 59 in the vertical direction on the first illumination opening 43 and second illumination opening 45 side respectively. Light that is inclined with respect to the vertical direction from the first main light source 58 toward the second illumination opening 45 is shielded by means of the enclosure 61. Similarly, light that is inclined with respect to the vertical direction from the second main light source 59 to the first illumination opening 43 is shielded by means of the enclosure 61.

A third board 62 in a vertical attitude is fixed to the housing 37 to the rear of the second reflector 44. A first auxiliary light source 63 is mounted on the surface of the third board 62. The first auxiliary light source 63 is formed from for example a surface-emitting LED device having directivity in the vertical direction of the board. A light path 63*a* of the first auxiliary light source 63 intersects the second reflector 44. That is, the headlight device 25 includes the second reflector 44 as a shielding part in front of the first auxiliary light source 63 in a front view of the vehicle body. Outgoing light in the vertical direction of the board from the first auxiliary light source 63 is shielded by means of the second reflector 44. The light is diffused within the housing 37. The diffused light leaks forward from the second auxiliary illumination opening 53.

Similarly, a fourth board 64 in a vertical attitude is fixed to the housing 37 to the rear of the first reflector 42. A second auxiliary light source 65 for low beam is mounted on the surface of the fourth board 64. The second auxiliary light source 65 is formed from for example a surface-emitting LED device having directivity in the vertical direction of the board. A light path 65*a* of the second auxiliary light source 65 intersects the first reflector 42. That is, the headlight device 25 includes the first reflector 42 as a shielding part in front of the second auxiliary light source 65 in a front view of the vehicle body. Outgoing light in the vertical direction of the board from the second auxiliary light source 65 is shielded by means of the first reflector 42. The light is diffused within the housing 37. The diffused light leaks forward from the first auxiliary illumination opening 52.

A fifth board 67 in a vertical attitude is fixed to a rear wall 66 of the housing 37 within the housing 37. A coupler (connecting part) 68 is fixed to the rear wall 66 of the housing 37 outside the housing 37. The coupler 68 is mounted on for example the fifth board 67. The coupler 68 is electrically connected to the fifth board 67. An electrical signal is supplied from the coupler 68 to the fifth board 67.

Figure 5:
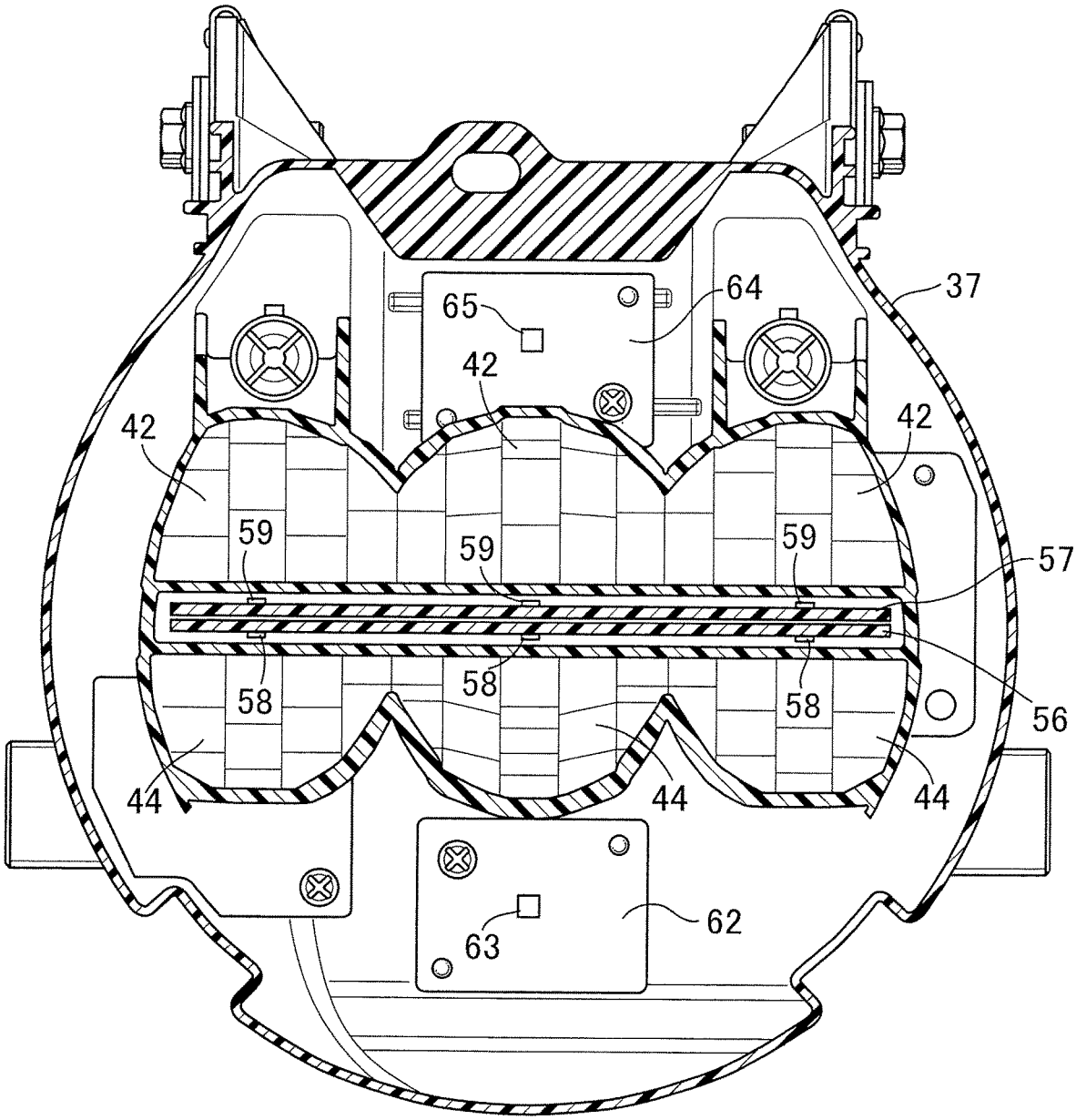
FIG. 5 is a sectional view along line 5-5 in FIG. 4. (first embodiment)

As shown in FIG. 5, in this embodiment three first main light sources 58 are mounted on the first board 56. The first main light sources 58 are arranged in the vehicle width direction of the vehicle body. The reflecting face of the second reflector 44 is adjusted for each of the first main light sources 58. Similarly, three second main light sources 59 are mounted on the second board 57. The second main light sources 59 are arranged in the vehicle width direction of the vehicle body. The reflecting face of the first reflector 42 is adjusted for each of the second main light sources 59. A single first auxiliary light source 63 is disposed to the rear of the second reflector 44 corresponding to the middle first main light source 58. Similarly, a single second auxiliary light source 65 is disposed to the rear of the first reflector 42 corresponding to the middle second main light source 59.

Figure 6:
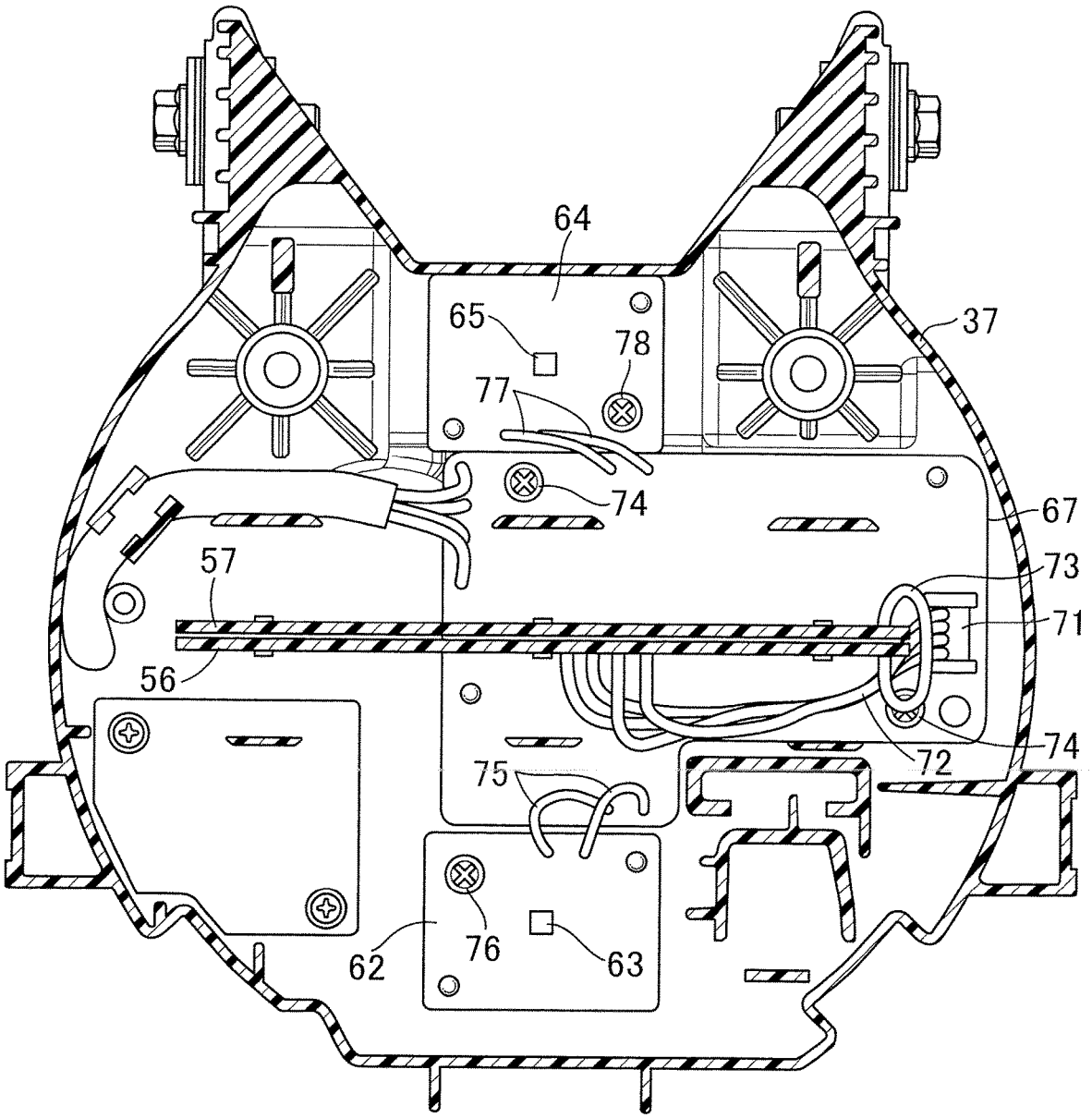
FIG. 6 is a sectional view along line 6-6 in FIG. 4. (first embodiment)

As shown in FIG. 6, a connector 71 is mounted on the fifth board 67. Joined to the connector 71 are a plurality of first wires 72. The first wire 72 is connected to the first board 56. The first board 56 and the second board 57 are electrically connected to each other by means of a second wire 73. In this way, the coupler 68 is electrically connected to the first board 56 and the second board 57 via the fifth board 67. The fifth board 67 is joined to the rear wall 66 of the housing 37 by means of a joining tool such as for example a screw 74.

The third board 62 is electrically connected to the fifth board 67 through a third wire 75. The third board 62 is joined to the rear wall 66 of the housing 37 by means of a joining tool such as for example a screw 76. Since both the fifth board 67 and the third board 62 are fixed to the rear wall 66 of the housing 37, the third wire 75 can be shortened.

The fourth board 64 is electrically connected to the fifth board 67 through a fourth wire 77. The fourth board 64 is joined to the rear wall 66 of the housing 37 by means of a joining tool such as for example a screw 78. Since both the fifth board 67 and the fourth board 64 are fixed to the rear wall 66 of the housing 37, the fourth wire 77 can be shortened.

Figure 7:
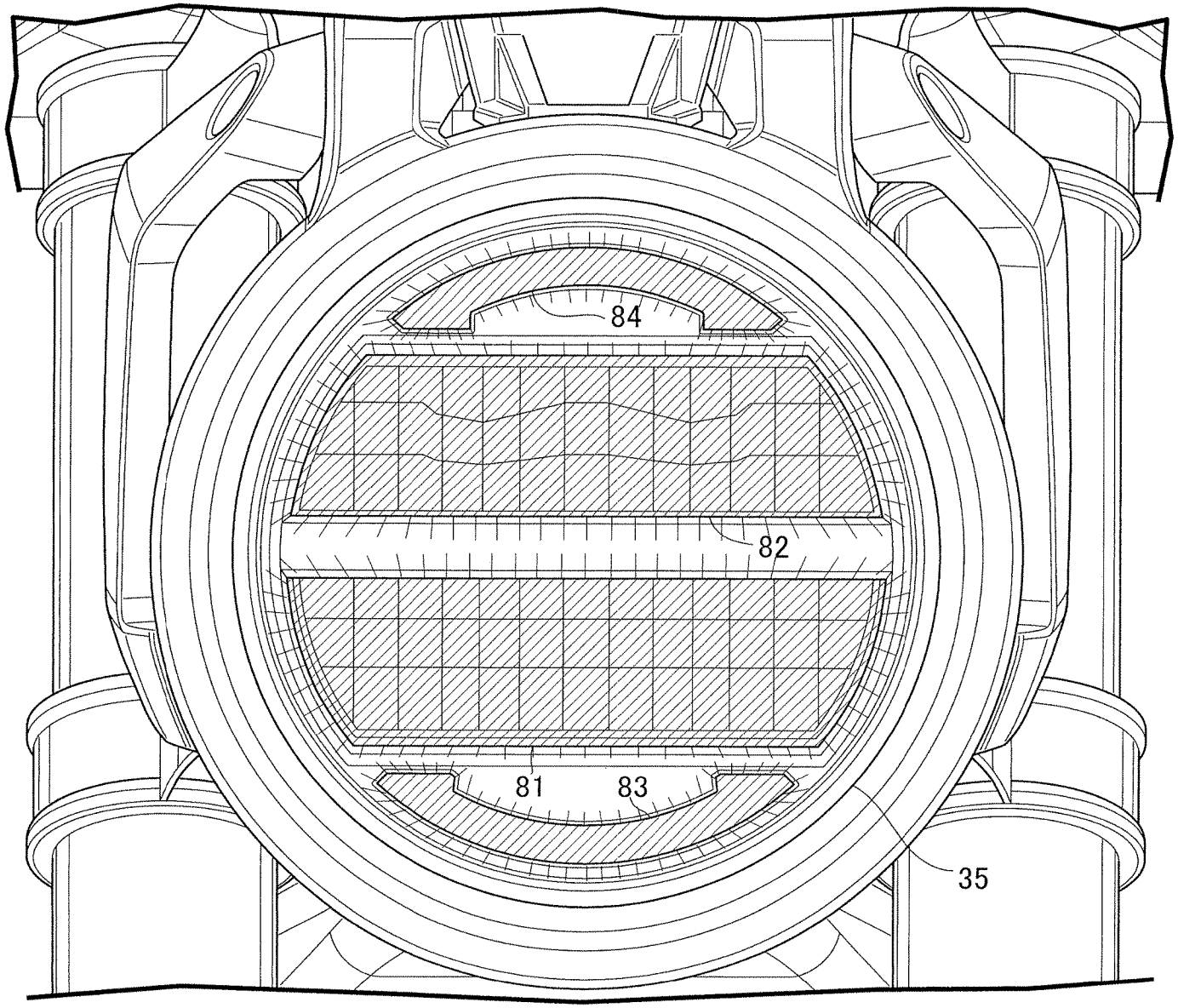
FIG. 7 is a front view of the headlight device schematically showing an illuminated region of the lens when high beam is turned on. (first embodiment)

The operation of the headlight device 25 is now explained. When the headlight device 25 is turned on with high beam, the first main light source 58, the second main light source 59, the first auxiliary light source 63, and the second auxiliary light source 65 emit light. Outgoing light from the first main light source 58 is reflected from the second reflector 44 and guided to the second illumination opening 45 of the frame 41. As shown in FIG. 7, light emitted from the second illumination opening 45 passes through an illumination range of a first section 81 of the lens 35. Similarly, outgoing light from the second main light source 59 is reflected from the first reflector 42 and guided to the first illumination opening 43 of the frame 41. Light emitted from the first illumination opening 43 passes through an illumination range of a second section 82 of the lens 35. Outgoing light from the first auxiliary light source 63 is shielded by means of the second reflector 44. The shielded light diffuses within the housing 37. The diffused light leaks from the second auxiliary illumination opening 53 of the frame 41. The leaked light passes through an illumination range of a third section 83 of the lens 35. Similarly, outgoing light from the second auxiliary light source 65 is shielded by means of the first reflector 42. The shielded light diffuses within the housing 37. The diffused light leaks from the first auxiliary illumination opening 52 of the frame 41. The leaked light passes through an illumination range of a fourth section 84 of the lens 35. Since the first illumination opening 43, the second illumination opening 45, the first auxiliary illumination opening 52, and the second auxiliary illumination opening 53 define the edge along the annular body 48 of the frame 41, the first to fourth light sources 58, 59, 63, and 65 can establish an illumination range that is close to a circular shape. In this way, the entire headlight can be made to appear bright.

Figure 8:
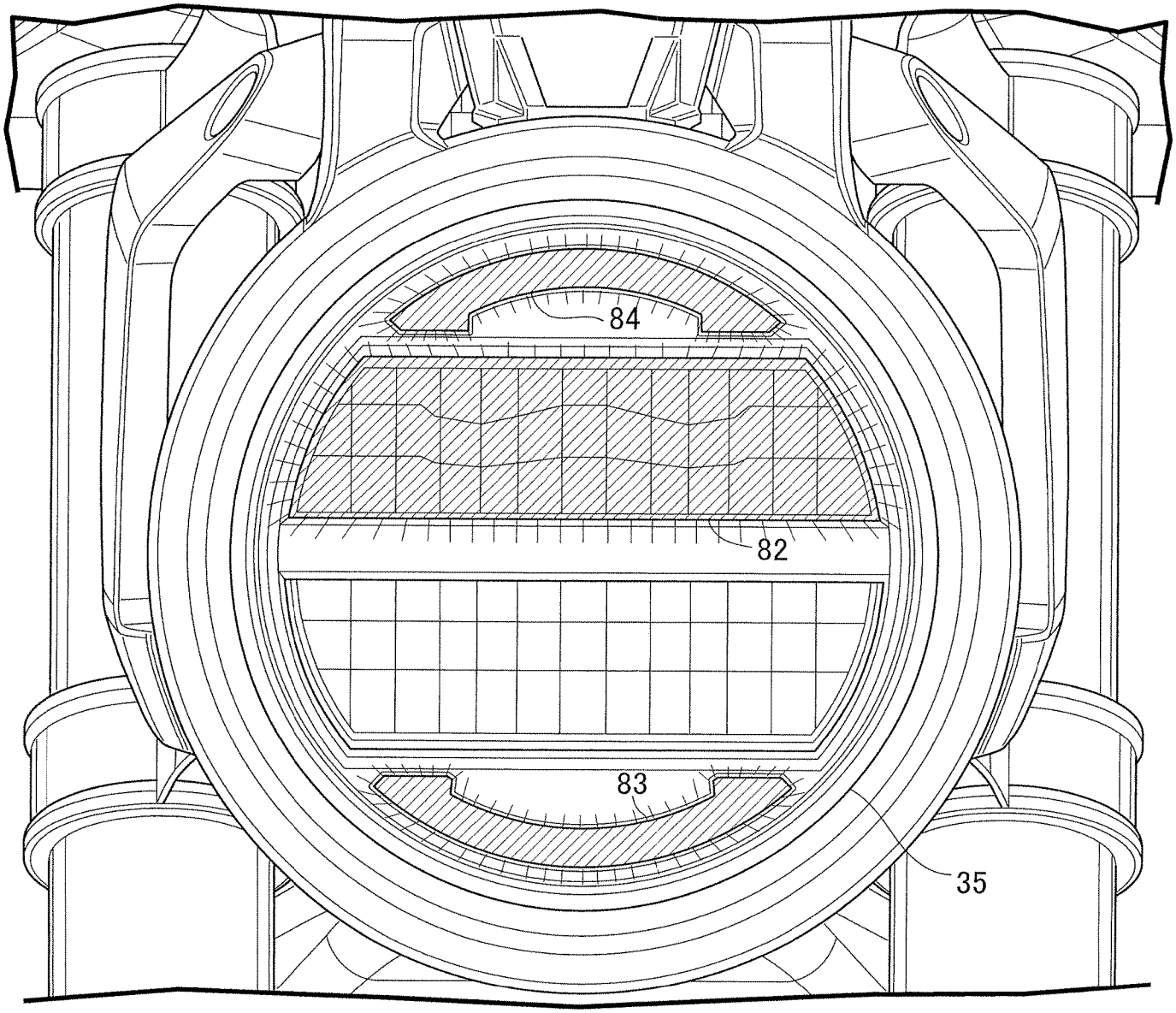
FIG. 8 is a front view of the headlight device schematically showing an illuminated region of the lens when low beam is turned on. (first embodiment)

When the headlight device 25 is turned on with low beam, the second main light source 59, the first auxiliary light source 63, and the second auxiliary light source 65 emit light. As shown in FIG. 8, an illumination range of the second section 82, the third section 83, and the fourth section 84 is established on the surface of the lens 35. Since the illumination range of the third section 83 is isolated by the first section 81 and distant from the illumination range of the second section 82, compared with a case in which light is perceived as a single illumination range, a wide illumination area is ensured for the surface of the lens 35. As wide a range as possible can be perceived as a bright illumination region.

In this embodiment since the second reflector 44 and the first reflector 42 as a shielding part are disposed in front of the first and second auxiliary light sources 63 and 65, it becomes possible to alleviate glare for an observer of the headlight device 25. Moreover, since each of the reflectors 42 and 44 functions as a shielding part, the dimensions of the headlight device 25 can be reduced in a front view of the vehicle body. Shielding of the auxiliary light source can be carried out with a small number of components.

Since the headlight device 25 includes the coupler 68 connected to the first board 56 and the second board 57 to the rear of the housing 37 and, moreover, the third board 62 and the fourth board 64 for the first and second auxiliary light sources 63 and 65 are fixed to the rear end (rear wall 66) of the housing 37, the wires 75 and 77 for the auxiliary light sources 63 and 65 can be shortened.

Figure 9:
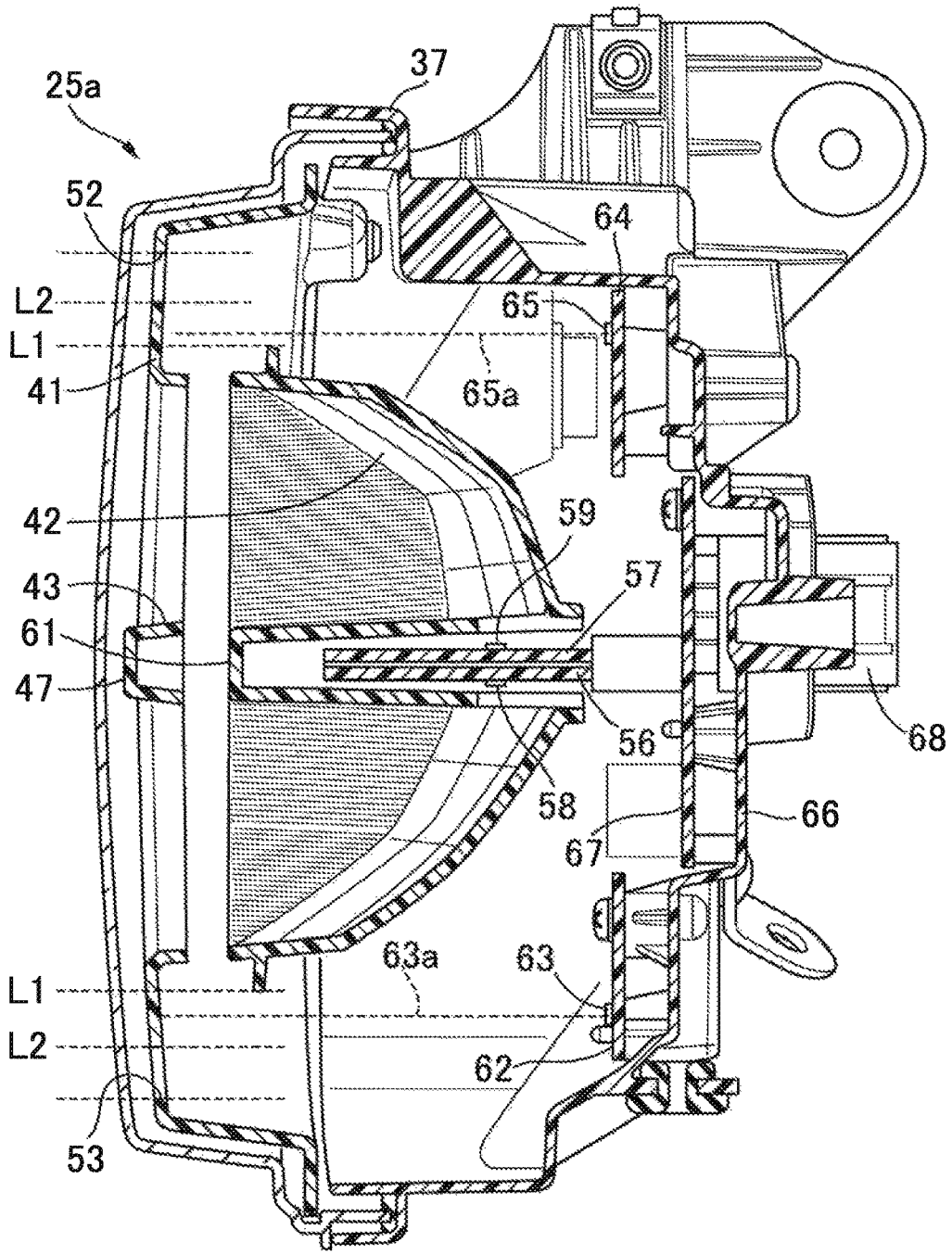
FIG. 9 is a sectional view schematically showing the arrangement of a headlight device related to another embodiment. (first embodiment)

FIG. 9 schematically shows the arrangement of a headlight device 25*a* related to another embodiment. In this embodiment, the frame 41 provided between the housing 37 and the lens 35 functions as a shielding part. That is, the frame 41 is disposed on the light path 63*a* of the first auxiliary light source 63. The light path 63*a* of the first auxiliary light source 63 deviates from the second illumination opening 45 and the second auxiliary illumination opening 53. Alternatively, the frame 41 is disposed on the light path 65*a* of the second auxiliary light source 65. The light path 65*a* of the second auxiliary light source 65 deviates from the first illumination opening 43 and the first auxiliary illumination opening 52. In this arrangement, in a front view of the vehicle body, in the second auxiliary illumination opening 53 a lower end L2 of the frame 41 is disposed further downward than a lower end L1 of the second reflector 44. In the first auxiliary illumination opening 52 an upper end L2 of the frame 41 is disposed further upward than an upper end L1 of the first reflector 42. The arrangement is otherwise the same as that of the headlight device 25 described above.

In either of the present embodiments, the headlight devices 25 and 25*a* include the housing 37 having the frame body 36 surrounding the outer periphery of the transparent lens 35 and supporting the lens 35, the main light sources 58 and 59 housed in the housing 37 and having a light path passing through the lens 35, and the auxiliary light sources 63 and 65 housed in the housing 37 and having the light paths 63*a* and 65*a* shielded by a shielding body (reflectors 42 and 44). Light emitted from the auxiliary light sources 63 and 65 is reflected from the reflectors 42 and 44 and diffuses within the housing 37. Light that is contained within the housing 37 leaks by passing through the lens 35. The amount of light of the main light sources 58 and 59 is assisted by the leaked light. An observer of the headlight device 25 does not directly see the auxiliary light source. Glare can be alleviated.

The invention claimed is:

1. A headlight device comprising:

a housing;

a transparent lens provided forwardly of the housing;

a first light source having directivity in a direction forwardly arranged within the housing without any reflector reflecting light from the first light source being arranged around the first light source;

a second light source arranged within the housing;

a reflector arranged within the housing and reflecting light of the second light source; and a frame provided between the housing and the lens, the frame comprising an illumination opening that defines an illumination range for light from the first light source, wherein the reflector is disposed on a light path of the first light source and shields light from the first light source.

2. The headlight device according to claim 1, further comprising a connecting part connected to a board mounted thereon with the second light source at a rear of the housing, wherein the first light source is provided at a rear end of the housing.

3. A headlight device comprising:

a housing;

a transparent lens provided forwardly of the housing;

a first light source having directivity in a direction forwardly arranged within the housing without any reflector reflecting light from the first light source being arranged around the first light source;

a second light source arranged within the housing;

a reflector arranged within the housing and reflecting light of the second light source;

a frame provided between the housing and the lens, the frame comprising an illumination opening that defines an illumination range for light from the first light source and a shielding part; and a light path of the first light source located outside of an edge of the reflector, as seen in a front view of the device, and the shielding part disposed on the light path and shielding light from the first light source.

4. The headlight device according to claim 3, further comprising a connecting part connected to a board mounted thereon with the second light source at a rear portion of the housing, wherein the first light source is provided at a rear end of the housing.

* * * * *